US005897094A

United States Patent [19]

Brugman et al.

[11] Patent Number: 5,897,094

[45] Date of Patent: Apr. 27, 1999

[54] BOP WITH IMPROVED DOOR CONNECTORS

[75] Inventors: James D. Brugman, Spring; Bryce A. Levett, Katy, both of Tex.

[73] Assignee: Varco Shaffer, Inc., Houston, Tex.

[21] Appl. No.: 08/777,301

[22] Filed: Dec. 27, 1996

[51] Int. Cl.[6] ..... E21B 33/06

[52] U.S. Cl. ..... 251/1.3; 251/1.1

[58] Field of Search ..... 251/1.1, 1.3

[56] References Cited

U.S. PATENT DOCUMENTS

| | | | |
|---|---|---|---|
| 3,156,475 | 11/1964 | Gerard et al. . | |
| 4,253,638 | 3/1981 | Troxell, Jr. . | |
| 4,558,842 | 12/1985 | Peil et al. | 251/1.3 |
| 4,566,372 | 1/1986 | Zandel et al. . | |
| 4,787,654 | 11/1988 | Zeitlin . | |
| 5,025,708 | 6/1991 | Smith et al. . | |
| 5,255,890 | 10/1993 | Morrill . | |
| 5,400,857 | 3/1995 | Whitby et al. . | |
| 5,575,452 | 11/1996 | Whitby et al. . | |

*Primary Examiner*—John Fox
*Attorney, Agent, or Firm*—Browning Bushman

[57] ABSTRACT

A blowout preventer 10 is provided for use in a hydrocarbon recovery operation to prevent a well blowout. The BOP body 20 has a central passageway 22 therein for receiving an oilfield tubular T. First and second radially opposing doors 16 and 18 are provided for sealing engagement with the corresponding side face 15 on the BOP body. First and second ram assemblies 12, 14 are each supported on a respective door and may be pressure energized for driving first and second ram blocks 24 into engagement with the oilfield tubular. A door connector 60, 90, 110, 140, 160 and 180 is provided for securing each door to the BOP body. Each door connector includes an upper connector bar and a lower connector bar 62, 64, 92, 94, 112, 114, 142, 144, 146, 148, 160 and 180 each having a bar axis generally perpendicular to the BOP body central axis. Each upper and lower connector bar is movable with respect to the BOP body from a locked position for locking the door into sealing engagement with the BOP body to an unlocked position for structurally releasing the door from the BOP body, such that the door may be disengaged from the BOP body for servicing the ram blocks. A significant feature of the present invention is the reduced time required to service the BOP ram blocks. The axial height of the BOP is desirably reduced by providing the upper and lower connector bars.

32 Claims, 9 Drawing Sheets

BOP WITH IMPROVED DOOR CONNECTORS

FIELD OF THE INVENTION

The present invention relates to blowout preventers (BOPs) which are conventionally used in hydrocarbon recovery operations to prevent well blowouts. More particularly, this invention relates to the BOP with an improved mechanism for structurally interconnecting the BOP body and each of the pair of radially opposing doors which support the ram assemblies, and for structurally disconnecting the doors from the BOP body during ram block service operations.

BACKGROUND OF THE INVENTION

BOPs have long been used in hydrocarbon recovery operations for preventing well blowouts. A BOP body has a central passageway therein for receiving an oilfield tubular. Radially opposing ram assemblies each mounted on a door are simultaneously actuated by hydraulic pressure to drive corresponding ram blocks into sealing engagement with the oilfield tubular during a well blowout condition, thereby reliably sealing the annulus between the BOP body and the oilfield tubular and preventing a hazardous well blowout condition.

Each BOP ram assembly is supported on a door which sealingly mates with a planar surface of the BOP body. The BOP door is secured to the body by a plurality of large bolts circumferentially spaced about the ram axis. During BOP service operations, the bolts are removed and the door may be structurally disconnected from the BOP body, thereby exposing the ram block for repair or replacement. BOP doors may be mounted on the BOP body by a hinge, as disclosed in U.S. Pat. Nos. 4,253,638 and 5,255,890, so that the BOP body supports the opened door during the service operation. Alternatively, the disconnected BOP doors may each be supported on a pair of rails extending from the BOP body.

Very high well blowout pressures may exist in the central passageway in the BOP body, and the doors must be sealed to the BOP body to prevent leakage of wellbore pressure. Some prior art BOPs rely upon the mechanical pressure applied by the door securing bolts to exert the force required to compress a seal between the door and the BOP body. High wellbore pressure exerts a tensile force on the door securing bolts since the door is forced by the wellbore pressure radially away from the BOP body, thereby creating a slight gap between the door and the BOP body which reduces the effectiveness of the seal. Other BOPs employ a fluid pressure responsive seal, as disclosed in U.S. Pat. Nos. 3,156,475, 4,566,372 and 4,787,654, so that the sealing force is directly related to the wellbore fluid pressure. When using this type of seal between the door and the BOP body, the sealing force thus increases with increased wellbore pressure. When using a pressure responsive seal, tensile force on the bolts still result in a slight gap created between the door and the BOP body when the BOP is subjected to high wellbore pressure, although this gap does not adversely affect the sealing effectiveness since the seal stays engaged with the body as the door moves, i.e., when the door bows, the seal stays fiat on the BOP body. The gap between the door and BOP body must be regulated, however, and most importantly the securing bolts must be sized for ensuring that the door does not structurally separate from the BOP body during a high pressure blowout condition.

Those skilled in BOP operations recognize that regular service of the BOP is required to ensure its high reliability.

In recent years, BOPs are increasingly used to seal high wellbore fluid pressures, and wellbore fluids are more commonly caustic, contain high water content, or are otherwise deleterious to the life of the ram block seals. Accordingly, the BOP door frequently must be separated from the BOP body to expose and service the ram block seals. The operation of separating the door from the BOP body is no easy task, and frequently requires special tooling sized to accommodate the large diameter bolts. After servicing the ram block seals, the door is reattached to the BOP body by rethreading each of the securing bolts mounted about the periphery of the ram axis. Special torque wrenches are required to ensure that the required torque is applied to each of the circumferentially spaced bolts. The operation of removing a door from the BOP body and reattaching the door after the ram block service operation may require several eight-hour shifts by skilled technicians. Those skilled in hydrocarbon drilling operations recognize that labor costs involved in servicing the BOP ram block seals is nominal compared to the effective cost of the rig down-time during this service operation, since millions of dollars of drilling related equipment may be idle during the BOPs operation.

Another problem with BOPs relates to the increasing axial height required by improved BOPs. Various BOPs have been designed which have advantages over prior art BOPs, but the improved design requires a larger axial spacing between the end faces or flanges of the BOP which each mate with conventional equipment used on a well drilling site. In many applications, the increased axial height required for an improved BOP is not possible or is highly undesirable in view of other parameters involved in equipment effecting the drilling operation. Accordingly, BOPs which provide improvements over the prior art but which result in increased axial length of the BOP body are frequently not widely received in the hydrocarbon recovery industry.

The disadvantages of the prior art are overcome by the present invention, and an improved blowout preventer for use in the hydrocarbon recovery operations is hereinafter disclosed. The blowout preventer of the present invention does not increase the axial height of the BOP, and instead desirably decreases the BOP axial height compared to prior art BOPs. Most importantly, the BOP provides a mechanism for easily and quickly disconnecting the BOP doors from the body during ram block service operations, while still providing a reliable seal between the BOP body and the doors during well blowout conditions.

SUMMARY OF THE INVENTION

A blowout preventer according to the present invention is used in hydrocarbon recovery operations to prevent a well blowout. A BOP body has a central axis to receive an oilfield tubular, and radially opposing side faces for sealing engagement with a respective door. Each door supports a ram assembly which may be hydraulically actuated to move a ram block into sealing engagement with the oilfield tubular. Each door may be hinged to the BOP body so that the door may be pivoted to an open position during a ram servicing operation, thereby exposing the ram block. Alternatively, the door may be disengaged from the BOP body supported on a pair of rails affixed to the BOP body, so that the rails support the door during the ram block servicing operation.

The BOP includes an improved mechanism for structurally connecting each door to the BOP body. Each door connector includes an upper elongate connector bar and a lower elongate connector bar each movable from a locked position for locking the door into secured engagement with the BOP body to an unlocked position for releasing the door from a BOP body, such that the door may be disengaged from the BOP body for a ram block servicing operation. A powered locking actuator may be provided for moving the connector bars between the locked and the unlocked positions. Each door preferably includes a fluid pressurized seal for sealing between the respective door and the BOP body when the door connector is in the locked position. Accordingly, the door connectors reliably secure the door in place to the BOP body, but the radial closing force provided by the door connector is not necessary to energize the seal between the door and the BOP body.

An elongate connector bar is provided adjacent an upper surface and a lower surface of each door. In one embodiment, each connector bar may be rotated about its bar axis between the locked and the unlock positions. A locking bar may also be provided movable along a locking bar axis from a lock position to a release position, such that the locking bar prevents rotation of the connector bar when in the lock position, and allows rotation of the connector bar when in the release position. In another embodiment, each of the upper and lower connector bars is movable along its respective connector bar axis from the locked position to the unlocked position. Each upper and lower connector bar may be a unitary member. Alternatively, each connector bar may include both a left-side elongate member and a right-side elongate member each independently movable with respect to the BOP body. Also, each connector bar may include a camming surface for forcing the respective door toward a BOP body when a connector bar is moved from the unlocked position to the locked position.

It is an object of the present invention to provide a BOP with an improved mechanism for structurally interconnecting each of the radially opposing doors to the BOP body, such that the doors are reliably secured to the BOP body when the door connectors are in the locked position, and allowing each door to be more easily disengaged from the BOP body for a ram servicing operation. Significant time savings are realized when disconnecting a door from a BOP body and reconnecting the door to the BOP body, thereby providing a significant cost savings to the well drilling operator.

It is another object of the present invention to provide an improved BOP with a mechanism for structurally interconnecting the door to the BOP body in a manner of which does not increase the axial height of the BOP, and instead preferably reduces the axial height of the BOP compared to prior art techniques for securing the door to the BOP body. The axial height of the BOP according to the present invention may be significantly reduced compared to prior art BOPs. Alternatively, the BOP of the present invention may include further features and modifications which require some increased axial height, so that the BOP with these additional features and modifications may still not have an axial height greater than prior art BOPs without those features and modifications.

It is a feature of the present invention that specialized tooling and equipment is not necessary to secure the door to the BOP body. A powered actuator mechanism may be used for moving the door connector from a locked position to an unlocked position and then back to the locked position.

Another feature of the present invention is that the connector mechanism for structurally connecting the door to the BOP body may be used on various types of BOPs, including BOPs with doors which are pivotally connected to the BOP body and BOPs provided with rails for supporting the door when moved to a ram service position.

It is an advantage of the present invention that the BOP door connector mechanism may be used with various types of seals for reliably sealing between the BOP body and the door. The door connector mechanism is particularly well suited for use with a pressure energized seal, wherein the sealing force increases in response to increased fluid pressure in the BOP body.

Another advantage of the present invention is that ram blocks of BOPs may be more reliably maintained, thereby further improving safety operations, since the time required to repair or replace seals on the ram block and place the BOP back in service is significantly reduced.

Yet another advantage of the present invention is that the cost of manufacturing a BOP is reduced. While the door connector mechanism of the present invention will likely have a slightly increased cost compared to prior art bolts which threadably connect the door to the BOP body, a substantial reduction in manufacturing in costs is achieved due to the reduced height and weight of the BOP.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
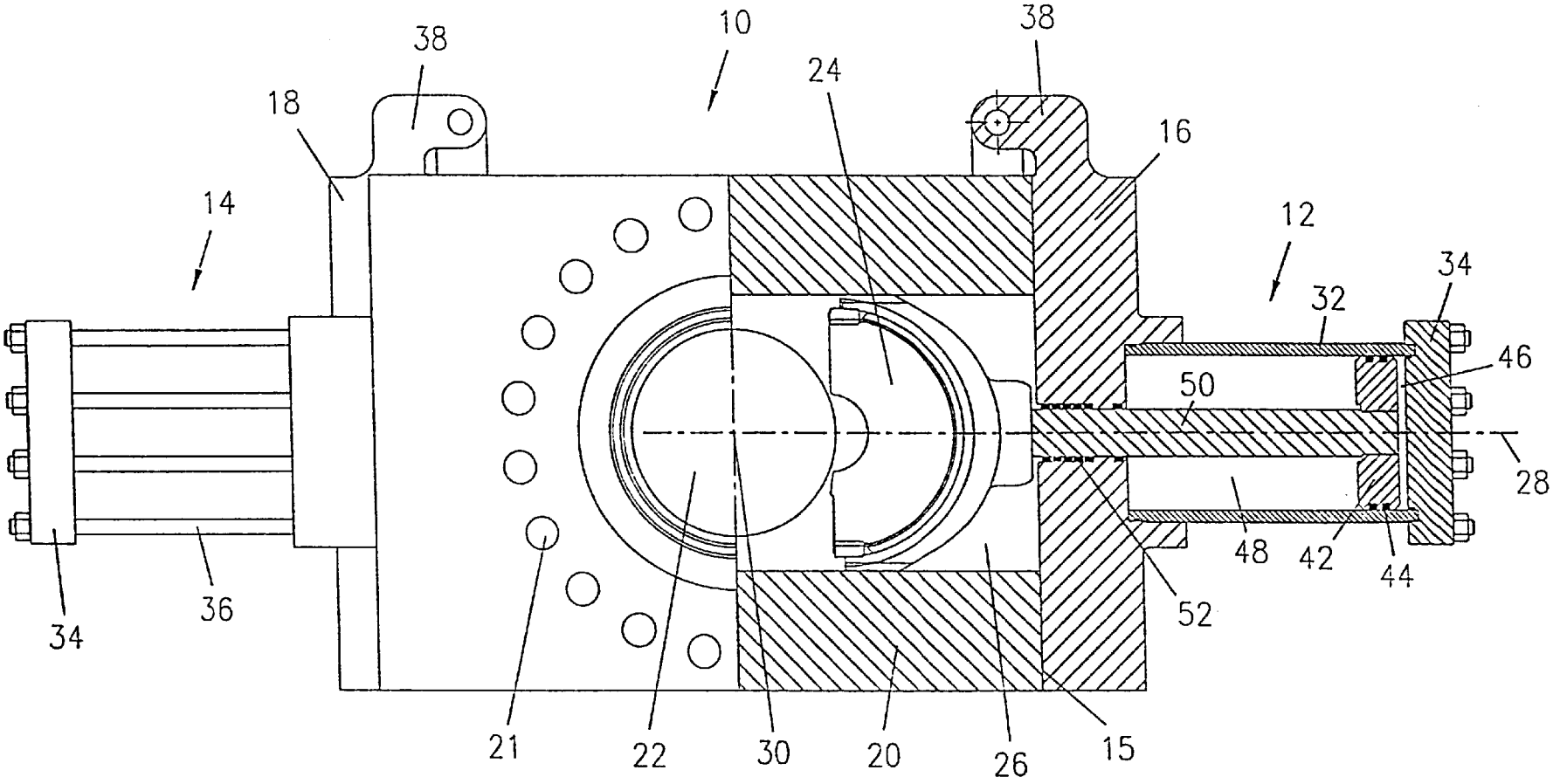
FIG. 1 is a top view, partial and cross-section, of a BOP according to the present invention.
Figure 2:
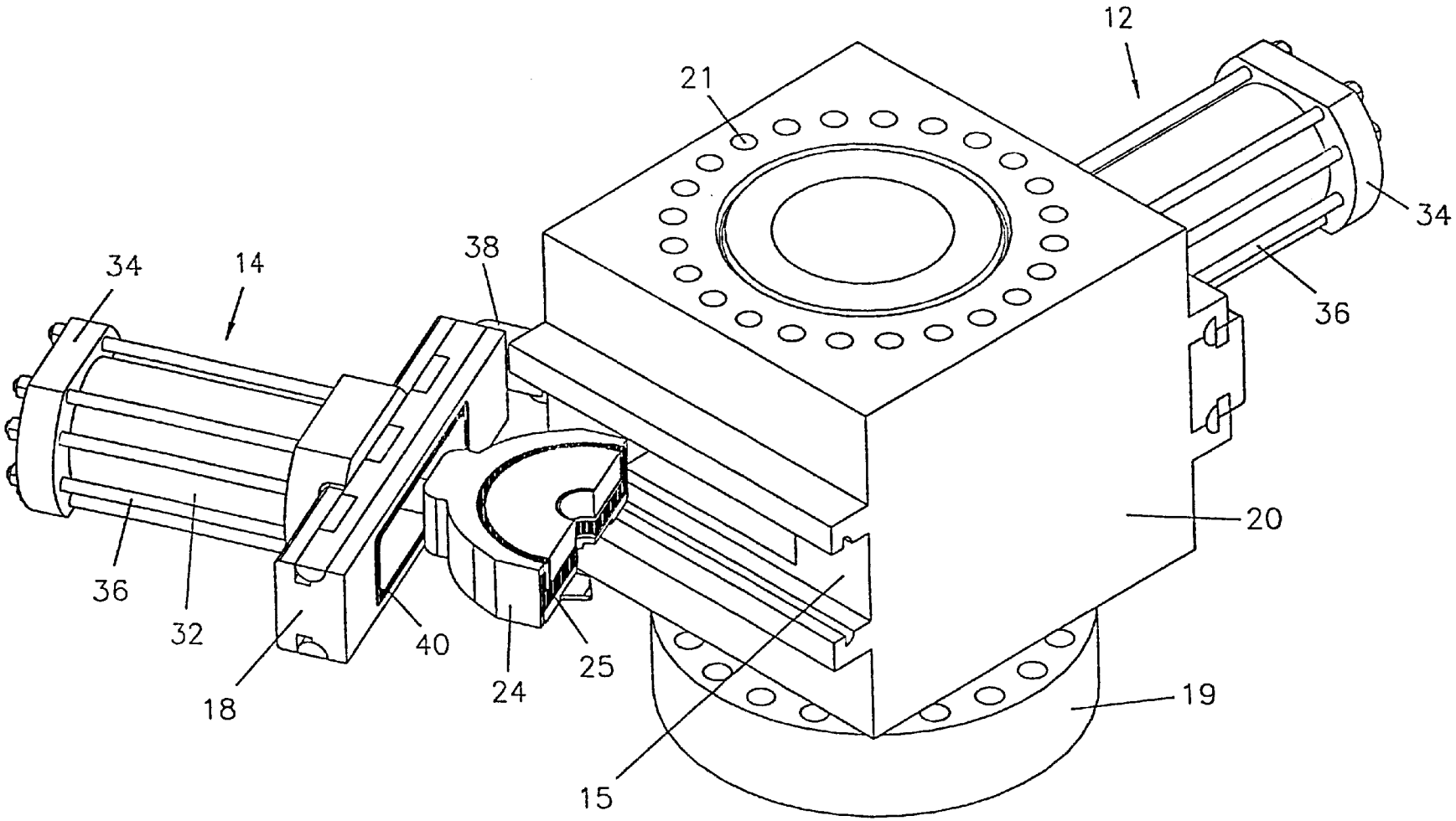
FIG. 2 is a pictorial view of a BOP door pivotally connected to a BOP body and in an open position for servicing the ram block.

FIG. 1 depicts atop view of a simplified blowout preventer (BOP) 10 including a pair of radially opposing fluid-powered ram assemblies 12, 14 each mounted on a respective door 16, 18. Each door 16, 18 is structurally secured to the BOP body 20 as described subsequently. The BOP body 20 has a central passageway 22 therein for receiving an oilfield tubular T that passes through the BOP and into the wellbore (not shown). Those skilled in the art will appreciate that the BOP body 20 may receive tubular members of various diameters. The tubular are generally vertical at the drilling platform on which the BOP is positioned, and may extend into a vertical, inclined, or generally horizontal wellbore. As shown in FIG. 2, the lower end of the BOP body 20 includes a lower flange 19 for bolted engagement with mating oilfield equipment, while the upper face of the BOP body 20 includes circumferentially arranged threaded holes 21 for facilitating bolted engagement with a lower flange of another piece of equipment spaced above the BOP.

A convention ram block 24 may be interchangeably installed on each ram assembly 12, 14 for reliably sealing with different oilfield tubulars within a range of diameters during a well blowout condition. The left side and the right side of the BOP 10 as shown in FIG. 1 are identical, so that both a top pictorial view and a cross-sectional view of a simplified BOP are effectively provided in FIG. 1. Each ram assembly 12, 14 and each door 16, 18 is thus preferably identical in design and construction, and accordingly the following description of one ram assembly and door applies to both ram assemblies and both doors.

The blowout preventer 10 thus includes two structurally similar and opposing ram assemblies 12, 14 provided on opposing sides of the BOP body 20. A radially extending central ram axis 28 of each ram assembly thus passes through and is perpendicular to the central axis 30 of the BOP passageway 22 that receives oilfield tubular T. Each ram assembly is partially received within a respective one of the radially opposing chambers 26 in the BOP body that extend radially outward from the central passageway 22.

As shown in FIGS. 1 and 2, each ram assembly may include a generally outer ram body 32 spaced between a respective one of the doors and an end plate 34. Conventional bolt and nut assemblies 36 may extend between the end plate 34 and a respective ram door, as more fully explained in U.S. Pat. No. 5,575,452. A simplified ram assembly 12 as shown in FIG. 1 includes a ram piston 42 which is continually in sealed engagement with ram body 32 by seals 44. Piston 42 separates the ram closing chamber 46 from the ram opening chamber 48. Those skilled in the art appreciate that hydraulic fluid is selectively supplied to the chambers 46 and 48 to move the piston 42 radially along ram axis 28. Various fluid flow lines supplying opening and closing pressure to the chambers 46 and 48 may be positioned and configured to accomplish the purposes of the invention. Rod 50 structurally interconnects the piston 42 to the ram block 24. Seals 52 maintain sealing engagement between the door 16 and the rod 50. Accordingly, the operator may simultaneously close both ram blocks 24 to seal against the tubular T by supplying pressurized fluid to the ram closing chambers 46 of the radially opposing ram assemblies 12, 14, and may thereafter unseal the ram blocks 24 and open the BOP to the position as shown in FIG. 2 by supplying pressurized fluid to the ram opening chambers 48.

Each door may be structurally secured to the BOP body 20 by the door connector as described subsequently. Each door is configured for mating engagement with one of the opposing side faces 15 of the BOP body intended for sealing engagement with a respective door. As shown in FIGS. 1 and 2, each door may be pivotally mounted to the BOP body by pivot arms 38, thereby allowing each door to be swung open to expose the ram sealing block 24, which may then be easily repaired or replaced. When the door 18 as shown in FIG. 2 is subsequently closed and is structurally secured to the BOP body 20 by the door connector, a seal ring 40 provides a reliable seal between the door and the BOP body.

Figure 3:
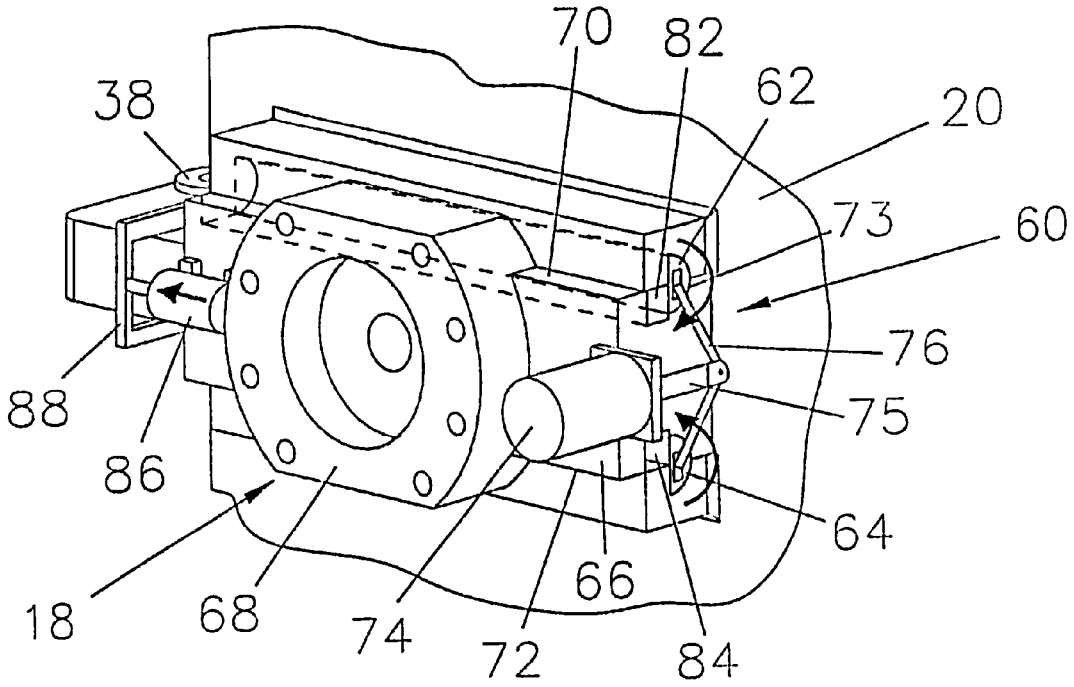
FIG. 3 is a simplified pictorial view of one embodiment of a BOP door connector according to the present invention. The semi-cylindrical upper and lower connector bars are shown in a locked position, and a powered mechanism is generally depicted for rotating each of the connector bars.
Figure 4:
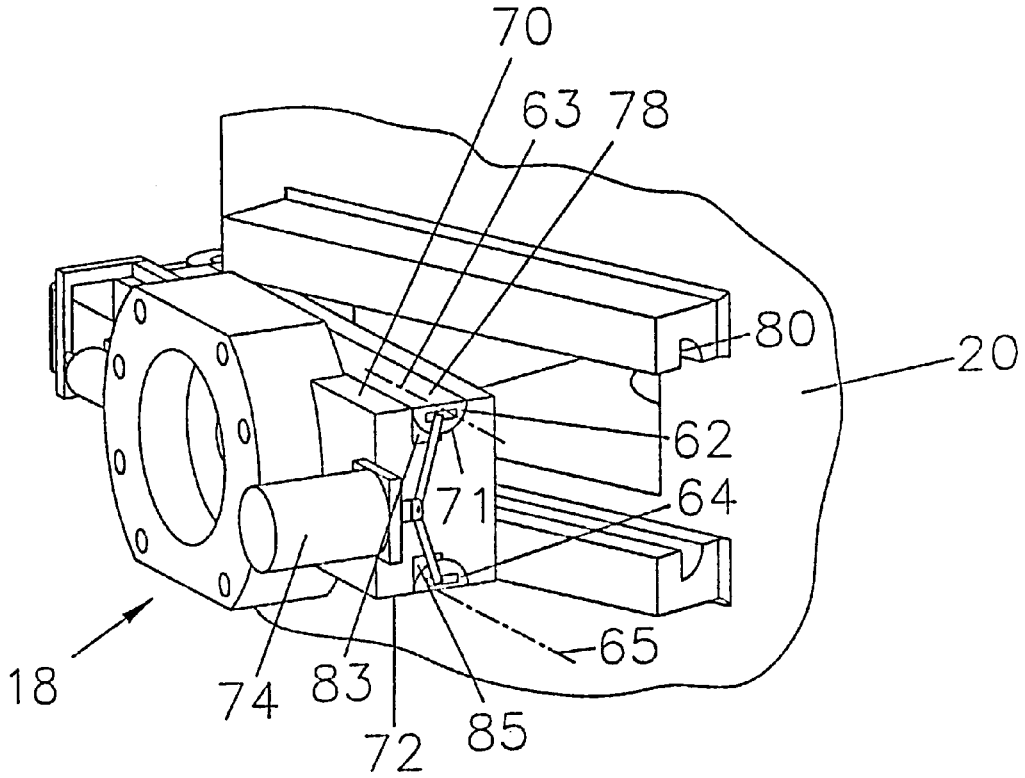
FIG. 4 is a simplified pictorial view of the BOP as shown in FIG. 3, illustrating the door connectors rotated to the unlocked position and the door pivoted in the partially open position.

FIGS. 3 and 4 depict one embodiment of a door connector 60 for structurally interconnecting the door 18 to the BOP body 20. For this embodiment, the door connector includes upper and lower elongate connector bars 62 and 64 respectively, each having a generally semi-cylindrical configuration. The door 18 includes a generally rectilinear block 66 and a radially outward extension 68 intended for engagement with the ram body 32. The ram body 32, the end plate 34, the connecting bolts 36, the piston 42, and the rod 50 are obviously removed from the components depicted in FIGS. 3–11. Those skilled in the art will appreciate that when the door is secured to the BOP body 20 as described subsequently, these components are supported on and extend radially outward from the door 18.

Each connector bar 62 and 64 is supported on and is positioned adjacent a respective upper surface 70 and lower surface 72 of the door 18. A powered linear actuator 74 is mounted on the door, and may be activated for moving an actuator rod 75 in a direction parallel to the ram axis 28. A slider crank mechanism 76 is provided for interconnecting the rod 75 with each of the connector bars 62 and 64. Accordingly, it should be understood that the actuator 74 may be powered for simultaneously rotating each connector bar 62 and 64 about its respective axis 63 and 65 from a locked position as shown in FIG. 3 to an unlocked position as shown in FIG. 4. When in the unlocked position, the door 18 may be swung open for a ram block service operation. After the ram block is repaired, the door may be moved to its closed position and the actuator 74 again powered to rotate the connector bars 62, 64 from the unlocked position as shown in FIG. 4 back to the locked position as shown in FIG. 3. Each connector bar 62 and 64 may be structurally identical. The interconnection with the slider crank mechanism 76 causes rotation of the connector bars in opposite directions, as shown in FIG. 3, when the actuator 74 is powered.

Referring to FIG. 4, the connector bar 62 has a planar BOP body engaging surface 78 which is in mating engagement with a connector engaging surface 80 on the BOP body 20 when the connector bar 62 is rotated to the locked position, as shown in FIG. 3. In one embodiment, each connector bar 62, 64 may be housed within a semi-cylindrical shaped cavity (not shown) in the upper and lower portions of the door 18, such that a planar face of each connector bar is flush with the top surface 70 and the lower surface 72 of the door when the connector bars are in the unlocked or door open position. A disadvantage of this embodiment is that high fluid pressure within the chamber 26 in the BOP body 20 exerts a radially outward force on the door 18 which will tend to rotate each connector bar 62, 64 from the locked position as shown in FIG. 3 to the unlocked position. Accordingly, to maintain each connector bar 62, 64 in the locked position for this embodiment, fluid pressure must be continually supplied to the actuator 74 to exert a torque on each connector bar 62, 64 sufficient to prevent inadvertent rotation of the connector bars to the unlocked position. This objective may be achieved by commercial available actuators, although the size of the actuator 74 and the size of the slider crank mechanism 76 must be designed for continuously transmitting the required torque to the connector bars. Moreover, this embodiment is not preferred since, if power is lost to the actuator 74, the required opposing torque may not be provided to the connector bars to prevent their inadvertent rotation to the unlocked position during a well blowout condition.

In a more preferred embodiment as shown in FIGS. 3 and 4, an upper and a lower locking bar 82 and 84 are provided for preventing inadvertent rotation of the connector bars 62 and 64. Each elongate locking bar 82 and 84 may have a rectangular cross-sectional configuration, and when in the lock position may fit within a respective cavity 83 and 85 having a similar configuration, as shown in FIG. 4. When each bar 82, 84 is in the lock position as shown in FIG. 3, each bar functions as a stop to prevent the rotation of the connector bar 62, 64 to the unlocked position. Accordingly, power need not be supplied to the actuator 74 to maintain the connector bars 62, 64 in the locked position even when high fluid pressure exists within the chamber 26 in the BOP body 20. In order to open the door, a powered linear actuator 86 may first be activated to move each elongate locking bar linearly along its respective axis (in a horizontal direction) from the lock position as shown in FIG. 3 to an unlock position, so that each bar is slid outward until its right-side end surface as shown in FIG. 3 is to the left of the left-side end surface of the connector bar. The actuator 86 may thus first be powered to linearly move the U-shaped connector arm 88 which structurally connects the actuator to an end of each locking bar 82, 84, so that the locking bars 82, 84 slide fully out of position for acting as a stop to prevent rotation of the connectors bars. Once the locking bars are moved to a release position, the actuator 74 may then be activated for rotating each connector bar 62, 64 to the unlocked position, as shown in FIG. 4, so that the door 18 may be opened. After the ram block service operation, the door may be closed, and the actuator 74 again activated to rotate the connector bars 62, 64 to the locked position, as shown in FIG. 3. The actuator 86 may then be powered to slide the locking bars 82, 84 back to the lock position, so that fluid pressure within the BOP body cannot inadvertently rotate the locking bars to the unlocked position.

Figure 5:
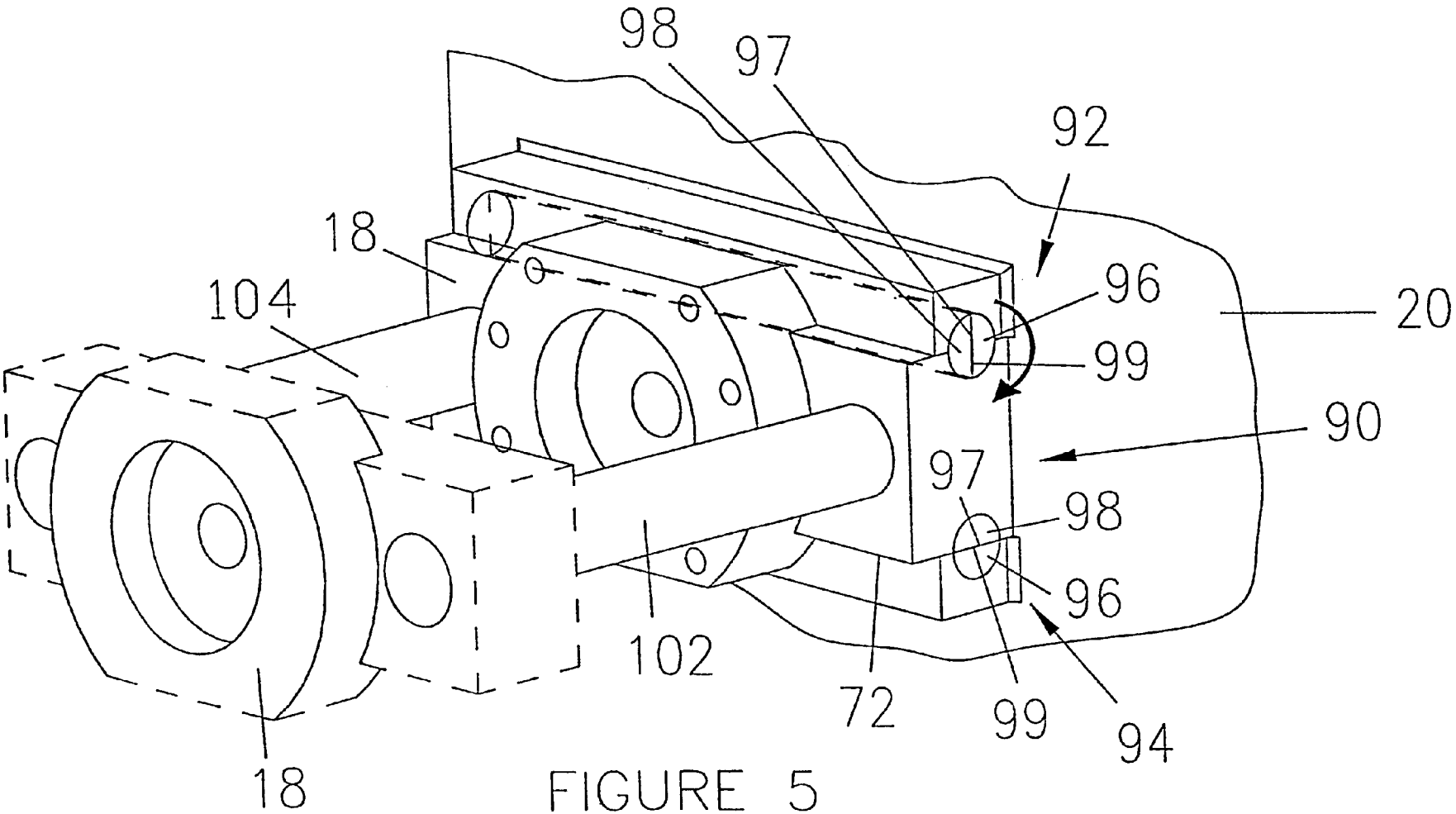
FIG. 5 is a simplified pictorial view of another embodiment of a BOP door connector according to the present invention, with the upper door connector being in the position and the lower door connector being in the unlocked position. The door is shown mounted to the BOP body on a pair of rails, so that the door may be moved radially outward from the BOP body to a service position, as shown in dashed lines.

FIG. 5 depicts another embodiment of a door connector 90 for securing the door 18 to the body 20. The upper and lower connector bars 92 and 94 are structurally identical, and comprise two semi-cylindrical elongate bar members 96 and 98 arranged such that their planar faces 97, 99 remain in planar engagement. When in the locked position, these mating surfaces 97, 99 are thus each vertical. Corresponding semi-cylindrical elongate cavities are provided in the door 18 and in the BOP body 20 for receiving the corresponding bars. A powered actuator may be provided for rotating the bar members 96, 98 from a locked position as shown for the upper connector bar 92 to an unlocked position as shown for the lower connector bar 94. When in the locked position, the connector bars thus prevent radially outward movement of the door 18 relative to the body 20. When rotated to the unlocked position as shown for the connector bar 94, the planar surfaces 97 and 98 of the connector bars 92 and 94 are horizontal and parallel with the lower surface 72 of the door. Accordingly, the door may then be moved to an open position.

By providing two semi-cylindrical connector bars 96 and 98 and corresponding semi-cylindrical cavities in the door 18 and the BOP body 20 (which cavities form an elongate cylindrical configuration when the door is closed), the tendency of high pressure in the BOP body 20 to rotate the connector bars from a locked position to an unlocked position is effectively eliminated.

As an alternative to providing a powered actuator for moving the connector bars between the lock and unlock position, it should be understood that a conventional lever arm (not shown) may be structurally connected to each connector bar, and each connector bar may thus be manually rotated from a locked position to an unlocked position. The door 18 may then be moved to a ram inspection or service position, the ram block serviced, the door 18 closed, and the connector bars manually moved from the unlocked position to the locked position to re-secure the door to the BOP body. A powered actuator or a manually manipulated lever may be used for moving any of the connector bars disclosed herein from a locked position to an unlocked position.

The upper and lower connector bars may be supported on the door, so that the connector bars move with the door to an open position when servicing the ram block. As an alternative, the upper and lower connector bars may be carried on the BOP body for engagement with an elongate slot provided in the upper and lower surfaces of the door. For an embodiment which mirrors FIGS. 3 and 4, each carrier bar, when in the unlocked position, fits within an elongate cavity in the BOP body. When in the locked position, each carrier bar rotates about its axis so that half of the carrier bar fits within a quarter cylindrical elongate cavity in the upper or lower portions of the door. To maintain the connector bar in the locked position, a locking bar moves into the elongate cavity in the BOP body to act as a stop in the same manner as described for FIGS. 3 and 4.

FIG. 5 depicts another mechanism for supporting the door from the BOP body during a ram block service position. As shown in FIGS. 1–4, the door is pivotally mounted to the BOP body so that it may be swung open to a ram block service position. As shown in FIG. 5, a pair of cylindrical rails 102 and 104 are each attached in a conventional manner to the BOP body 20, and extend radially outward therefrom in a cantilevered fashion through corresponding ports in the door. When the door connector 90 is moved to the unlocked position, the door 18 may be slid radially outward to a ram block service position, as shown in dashed lines in FIG. 5, with the door 18 and the corresponding ram assembly being supported on the rails 102 and 104.

Figure 6:
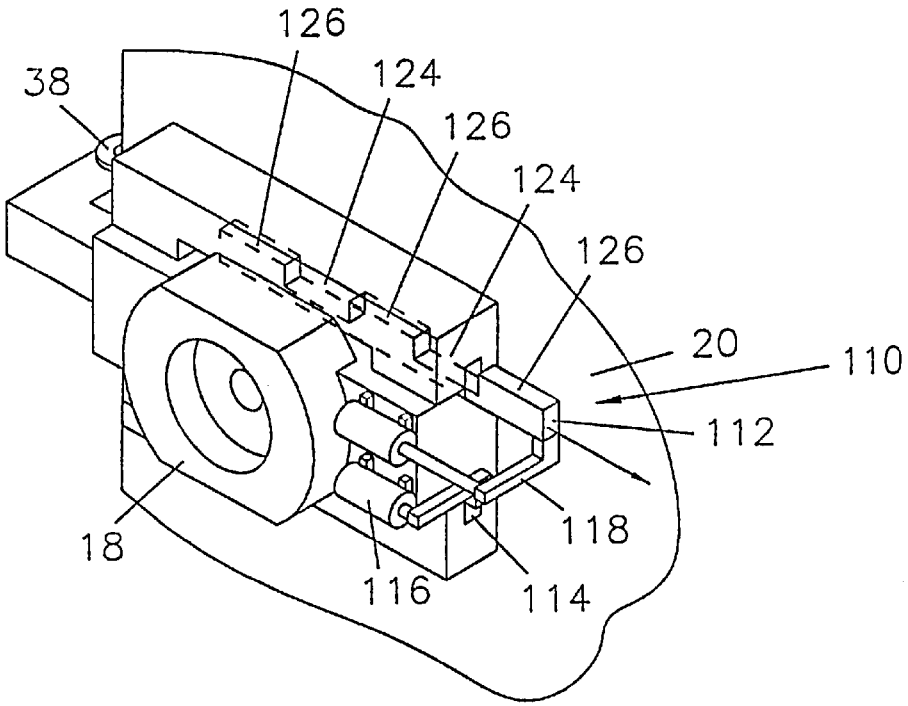
FIG. 6 is a simplified pictorial view of yet another embodiment of the BOP door connector according to the present invention. The upper connector bar is depicted in the unlocked position and the lower connector is depicted in the locked position. A powered opening and closing mechanism is generally shown for moving each connector bar between the locked and the unlocked positions.
Figure 7:
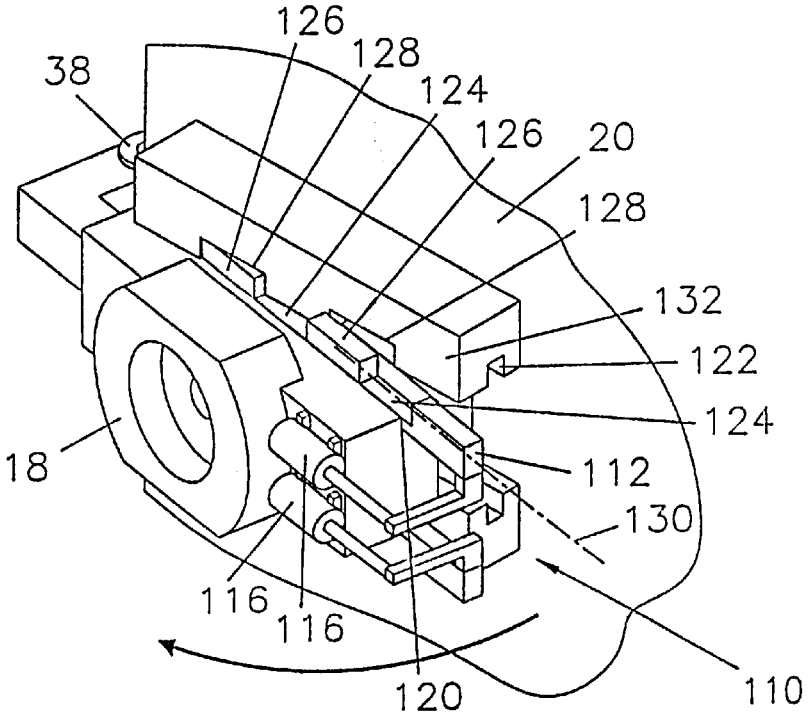
FIG. 7 is a simplified pictorial view of the BOP as shown in FIG. 6 with the door partially opened for a BOP servicing operation.

FIGS. 6 and 7 disclose another embodiment of a door connector 110 for securing the door 18 to the BOP body 20.

The connector comprises an upper elongate connector bar 112 and a similar lower elongate connector bar 114. For the FIGS. 6 and 7 embodiment, a powered locking actuator 116 is provided for each connector bar, so that each bar may be independently moved from a locked position to an unlocked position by the corresponding actuator 116. Various types of linear or rotary actuators may be used to linearly move or rotate one or both connector bars. A suitable linear actuator is the Parker 3L Medium Duty Hydraulic Cylinder. An L-shaped link member 118 is provided in the FIGS. 6 and 7 embodiment for structurally interconnecting the actuator with each corresponding connector bar. The upper connector bar 112 is shown in the unlocked position in FIG. 6, while the lower connector bar 114 is shown in the locked position. Each connector bar 112, 114 is thus linearly movable by its actuator from a locked position to an unlocked position.

As shown in FIG. 7, each connector bar is partially housed within an elongate groove 120 in the door, and partially within a similarly configured elongate groove 122 in the body 20. A plurality of axially spaced slots 124 are provided along the length of each connector bar, thereby forming a plurality of upwardly extending projections 126 on the upper connector bar 112, and a similar number of downwardly extending projections on the lower connector bar 114. A plurality of recesses 128 are provided in the upper part of the BOP body 20 each for receiving a corresponding one of the projections 126, while similar recesses are provided in a lower part of the BOP body for receiving similar downwardly directed projections on the lower connector bar 114. Each of the slots 128 thus extends from the slot 122 in the body to the radially outer surface 132 of the body 20. The number and size of the projections 126 on each connector bar 112 and 114 must be sufficient to withstand the forces to prevent opening of the door 20 when high pressure exists within the interior of the BOP body 20, and suitable safety factors are employed when determining the size and number of necessary projections.

Connector bar 112 may thus be moved to a locked position, wherein each of the plurality of projections 126 is in engagement with the body to prevent opening of the door to an unlock position, wherein the projections 126 are aligned with the corresponding slots 128 in the door, at which time the door may be swung open. It should be appreciated that any number of projections and corresponding recesses may be provided in the connector bar and in the body. For the embodiment as shown in FIG. 6, only two recesses and three projections are provided on the bar 112, since the right side projection on the bar 112 moves out of the slot 122 when the bar 112 is moved to the unlocked position. More or less recesses and projections may be provided, and for other embodiments an equal number of recesses and projections may be used if the bar 112 does not slide horizontally past the edge of the door 18. Those skilled in the art will appreciate that each bar 112, 114 may be moved linearly along its respective axis 130 by the powered actuator 116. With respect to the axis 130, the length of each projection 126 will be less than the axial length of the corresponding recess 128, since precise regulation of the axial travel of the bar 112 is not necessary, and since some spacing between the ends of a projection and the sides of the recess is required so that the door 18 may pivot to the open position when both of the connector bars 112 and 114 are in the unlocked position. Also, various cross-sectional configurations for each bar 112 and 114 may be employed for facilitating the purpose and function of the connector bars 112 and 114 as shown in FIGS. 6 and 7. A connector bar with a generally rectangular cross-sectional configuration with axially spaced projections also having a rectangular cross-sectional configuration is preferred for ease of manufacturing.

Figure 8:
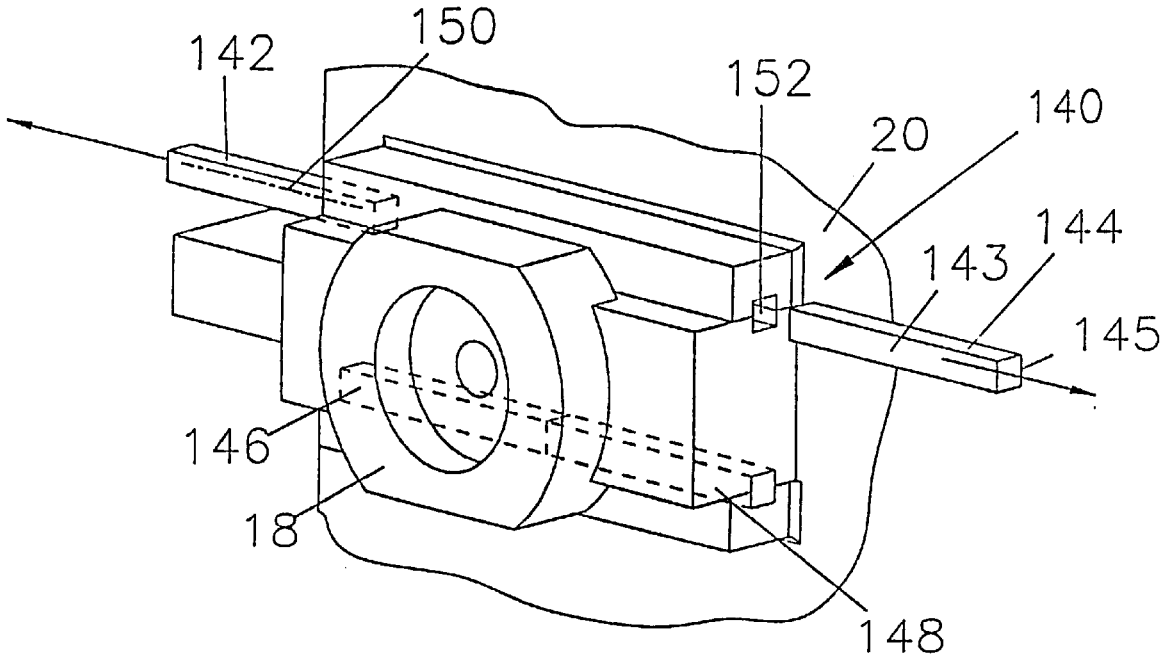
FIG. 8 is a simplified pictorial view of yet another embodiment of a BOP according to the present invention, illustrating the upper connector bars in an unlocked position and the lower connector bars in a locked position.
Figure 9:
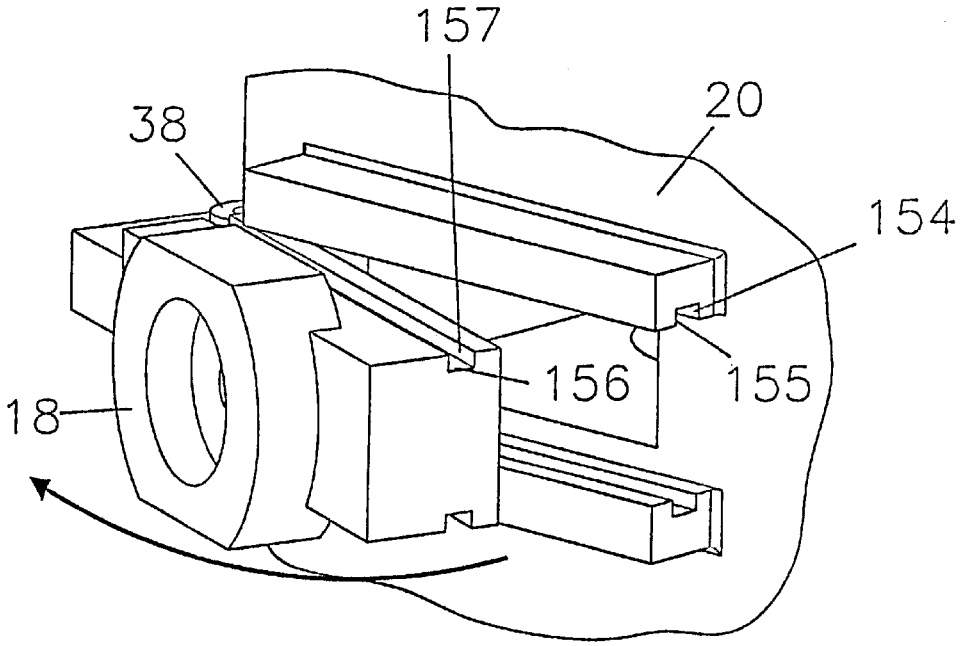
FIG. 9 is a simplified pictorial view of the BOP as shown in FIG. 8 with the door pivotally opened for a BOP servicing operation.

FIGS. 8 and 9 disclose yet another embodiment of a door connector 140 for interconnecting the door 18 to the body 20. The door connector comprises a left-side upper connector bar 142 and a right-side upper connector bar 144, and a corresponding lower left-side connector bar 146 and right-side connector bar 148. Each connector bar is movable linearly along its respective axis 150. As with the other embodiments, the connector bars may be moved from a locked to an unlocked position by a powered actuator, or may be manually moved. Each connector bar 142, 144, 146 and 148 has a generally rectangular cross-sectional configuration, and moves linearly within a slot 152 formed partially in the BOP body 20 and partially in the door 18. The rectangular-shaped slot 152 thus comprises an elongate slot 154 formed in the BOP body and a similar elongate slot 156 formed in the door 18. The upper connector comprising the left-side and right-side connector bars 142 and 144 are shown in their unlocked position, and the lower connector comprising a left-side bar 146 and a right-side bar 148 are depicted in their locked position. When the upper and lower connector bars are moved to their unlocked position, the connector bars are structurally separate from both the door 18 and the BOP body 20, and the door 18 may then be pivoted to the open position, as shown in FIG. 9.

The connector 140 as shown in FIGS. 8 and 9 is similar in some respects to the connector 110 shown in FIGS. 6 and 7. Obviously less movement of each connector bar along its respective axis is required for the embodiment as shown in FIGS. 6 and 7 compared to the embodiment shown in FIGS. 8 and 9. Also, those skilled in the art will now appreciate that one elongate connector bar may be employed for both the upper connector bar and the lower connector bar, rather than using a left-side and a right-side connector bar as shown in FIG. 8. Similarly, upper and lower connector bars each having a semi-cylindrical configuration similar to that shown in FIGS. 3 and 4 may be employed with each of the upper and lower connector bars comprising both a left-side connector bar and a right-side connector bar. Also, each upper and lower connector bar for an embodiment similar to that shown in FIG. 5 or similar to the embodiment shown in FIGS. 6 and 7 may comprise both a left-side and a right-side connector bar. The primary advantage of providing both a left-side and a right-side connector bar for the FIGS. 8 and 9 embodiment is that the spacing necessary to completely remove the bar from its corresponding slot is reduced in the FIGS. 8 and 9 embodiment compared to the alternative wherein a unitary upper bar and a unitary lower bar are employed.

Each door connector according to the present invention thus includes an upper elongate connector bar having upper bar axis generally perpendicular to the BOP central axis for securing the door to the BOP body, and a lower elongate connector bar having a lower bar axis also generally perpendicular to the BOP central axis for securing the door to the BOP body, with the lower door axis being parallel to the upper bar axis. Each upper and lower connector bar has a door engaging surface for mating engagement with a connector engaging surface on the door. In the FIGS. 3 and 4 embodiment, the door engaging surface on the connector bar 62 is the lower curved surface 73 shown in FIG. 3, and the connector engaging surface on the door is the mating curved surface 71 of the door 18 shown in FIG. 4. In the FIGS. 8 and 9 embodiment, the door engaging surface is the lower inner face 145 of locking bar 144, and the connector engaging surface on the door is the inner face 157 of the slot 156 in the door, as shown in FIG. 9. Each connector bar also has a BOP body engaging surface thereon for mating engagement with a connector engaging surface on the BOP body. In the FIGS. 3 and 4 embodiment, the BOP body engaging surface on the connector bar is the upper planar face 78 of the connector bar 62, and the connector engaging surface on the BOP body is the planar surface 80 shown in FIG. 4. In the FIGS. 8 and 9 embodiment, the BOP body engaging surface is the upper outer face 143 of the locking bar 144, and the connector engaging surface on the BOP body is the outer face 155 of the slot 154 in the BOP body. The door engaging surface on the connector bars, the connector engaging surface on the door, the BOP body engaging surface on the connector bars, and the connector engaging surface on the BOP body for the other disclosed embodiments will be apparent to those skilled in the art from the above description. Each upper and lower connector bar is movable with respect to the BOP body from a locked position for locking the door into sealing engagement with the BOP body to an unlock position for structurally releasing the door from the BOP body, such that the door may be disengaged from the BOP body when the upper and lower connector bars are in the unlocked position for a BOP servicing operation.

A significant feature of the present invention, which is applicable to each of the embodiments described above, is that door connector bars are provided adjacent both an upper and a lower surface of the door for reliably securing the door to the BOP body, although the axial height of the BOP may be significantly reduced compared to prior art BOPs which have long utilized conventional bolts circumferentially spaced about the perimeter of the door for securing the door to the BOP body. This reduced axial BOP height objective is obtained according to the present invention because a large bearing surface is provided between each connector bar and both the door and the BOP body within very little height of the BOP, since each door connector is an elongate member with a relatively short height. Regardless of whether the door is hinged on its side or whether rails or beams extending from the BOP body are provided for supporting the door when moved to the ram block service position, the door connector which structurally connects the door to the BOP body according to this invention preferably comprises an upper door connector and a lower door connector each spaced adjacent a corresponding upper surface and lower surface of the door. While theoretically a pair of elongate door connectors could be provided between the door and the BOP body with the pair of door connectors being a left-side door connector and a right-side door connector, such an embodiment would present significant problems with respect to the door bowing outwardly in response to high fluid pressure within the interior of the BOP, with the maximum bowing being in a vertical plane equally spaced between the left-side and the right-side door connectors. The increased emphasis in recent years to utilize a BOP which has an axially short height has resulted in relatively thin ram blocks, although the ram blocks inherently need a horizontal width which is sufficient to seal against the tubular. It may seem initially inconsistent that the utilization of upper and lower door connectors each requiring some axial spacing results in a BOP with a reduced axial height rather than an increased axial height. As noted above, this is accomplished due to the elongate configuration of the upper and lower door connectors, which provide a very large surface bearing area within a relatively short axial spacing.

Figure 10:
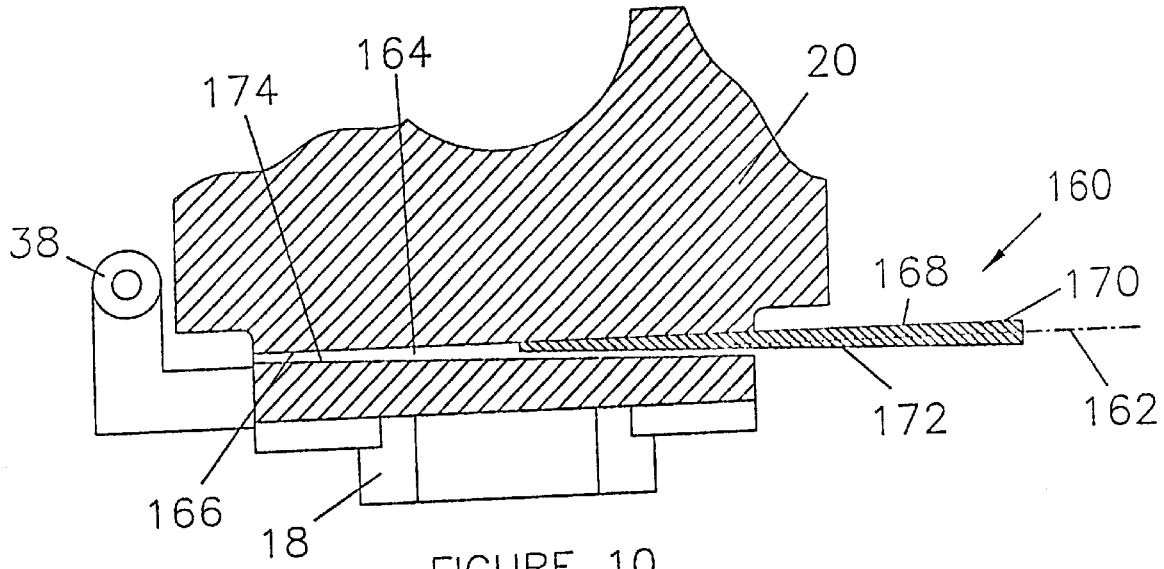
FIG. 10 is a simplified top view of a portion of a BOP with a door connector bar similar to the embodiment shown in FIGS. 8 and 9, but modified to provide a camming function to more securely lock the door to the BOP body.
Figure 11:
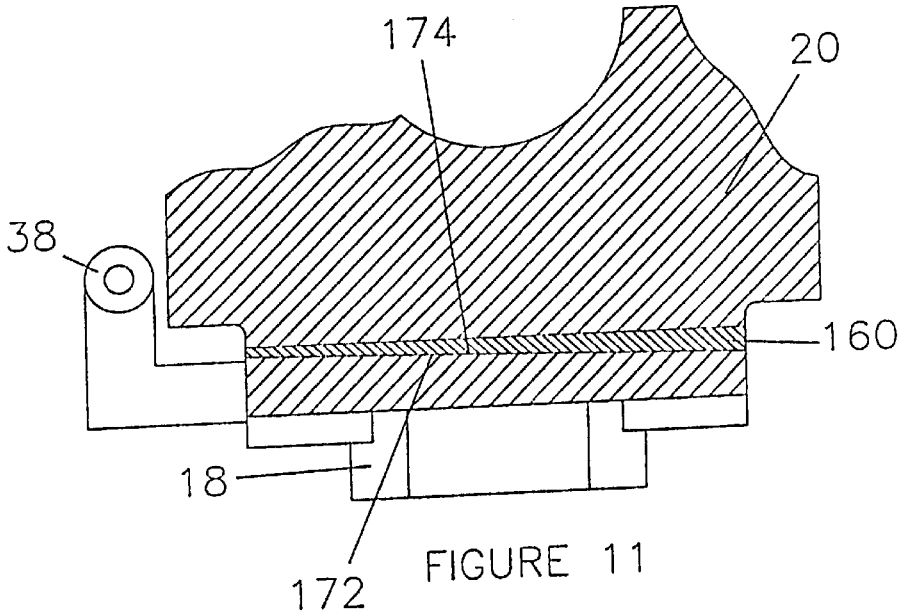
FIG. 11 is a simplified top view of the BOP shown in FIG. 10 with the door connector bar in the locked position.

FIGS. 10 and 11 illustrate that a camming function may be utilized for assisting in forcing the door 18 radially inward into tight engagement with a BOP body 20. To illustrate this camming function, a top view is shown for one of the upper and lower elongate connector bars 160. Connector bar 160 is generally of the type as shown in FIGS. 8 and 9, although a single upper connector bar and single lower connector bar are used in the embodiments as shown in FIGS. 10 and 11, rather than a left-side and a right-side connector bar for each of the upper and lower connectors. The connector bar 160 as shown in FIGS. 10 and 11 has a uniform height, and in that respect is thus similar to the connector bar shown in FIGS. 8 and 9. Moreover, the connector bar moves linearly along an axis 162 within the elongate slot in the door and the BOP body. The slot in the door 18 has a uniform radially width and is thus similar to the slot 156 as shown in FIG. 9. For the FIGS. 10 and 11 embodiment, the slot 164 cut in the BOP body 20 does not have a uniform radial width, and instead includes a tapered surface 174. The front face 168 of the connector bar 160 slides against the front surface 166 of a slot 164, and each of these surfaces is parallel to the elongate axis 162 of the connector bar 160. The rear surface 172 of a connector bar 160 is tapered with respect to the axis 162, however, and the rear surface 174 of the slot 164 in the BOP body similarly has a mating tapered surface 174. Those skilled in the art will appreciate that the further the connector bar 160 is driven into the slot 164 and toward the hinge 38 of the door, the tighter the door 18 is forced radially inward into engagement with the BOP body 20. Accordingly, by providing the tapered surface 172 on the connector bar 160 and a similarly configured tapered surface 174 on the BOP body 20, the force applied in the direction of the connector bar axis 162 to press the connector bar into the slot 164 determines the compressive force applied by the door 18 against the body 20.

FIG. 11 thus depicts the connector bar 160 in its fully cammed position with the tapered camming surfaces 172 and 174 being in mating engagement for applying a high compressive force which urges the door 18 into tight engagement with the BOP body 20. If desired, markings or gradations 170 may be provided along the axial length of the connector bar 160, thereby allowing the operator to desirably position the connector bar 160 with respect to the BOP body 20 at a position which will apply the predetermined amount of compressive force between the door 18 and the body 20.

Figure 12:
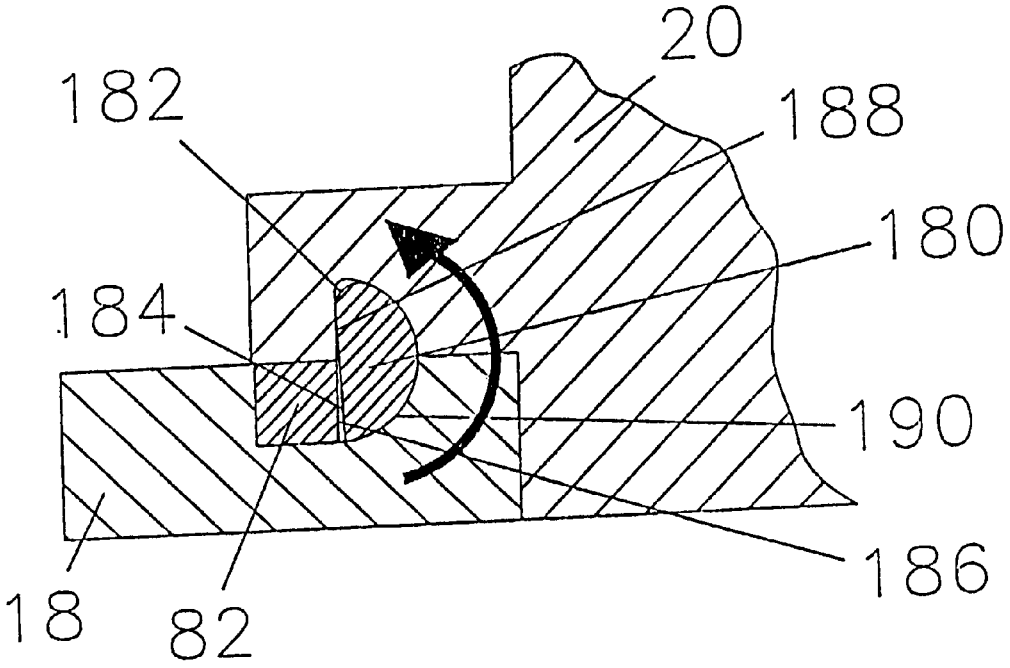
FIG. 12 is a simplified end view of a portion of a BOP according to the embodiment as shown in FIGS. 3 and 4. The connector bar is shown in its locked position and the locking bar is also shown in its locked position. The connector bar is over rotated to its locked position prior to the application of high fluid pressure within the BOP.
Figure 13:
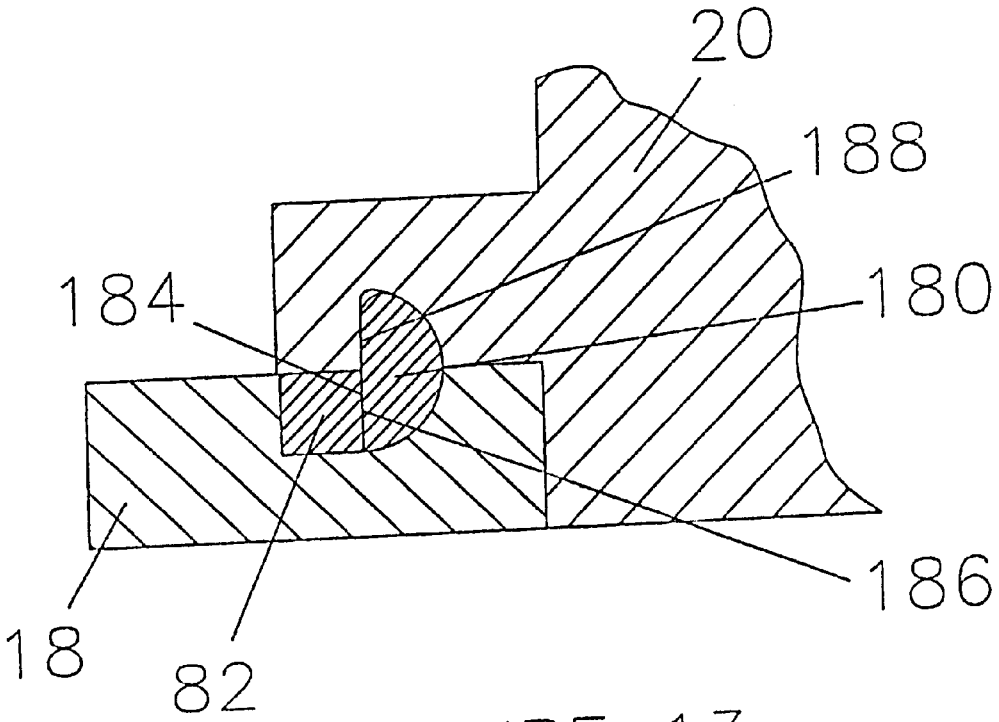
FIG. 13 is an end view of a portion of the BOP as shown in FIG. 12, with the connector bar being positioned with respect to the locking bar once high fluid pressure is applied to the interior of the BOP.

FIGS. 12 and 13 illustrate how this camming function may be applied to a rotary connector bar, and also illustrate how over-rotation of the connector bar results in the desired planar engagement of the connecting bar and both the lock bar and the BOP body when high fluid pressure is in the BOP body. The connector bar 180 as shown in the end views in FIGS. 12 and 13 is thus very similar to the connector bar 62 shown in FIG. 3. Upper and lower connector bars 180 may thus be rotated to the locked position for securing the door 18 to the BOP body 20. As explained above, the configuration and purpose of the lock bar 82 is to prevent inadvertent rotation of the connector bar 18 to the unlocked position until the lock bar 82 is moved along its axis to its release position.

With respect first to the camming function, it may be seen in FIGS. 12 and 13 that the upper edge of the connecting bar 180 is rounded at 182, and that the connector bar 180 is over-rotated so that the planar surface 184 of the connector bar 180 is tilted slightly with respect to the front face 186 of the lock bar 82, which is coplanar with the planar surface 188 of the BOP body 20. By over-rotating the connector bar 180 to the position as shown in FIG. 12, it may be understood that the rounded surface 182 provides substantially line contact with the planar surface 188, and that this line of engagement between 182 and 188 is spaced above the rotational axis of the bar 180. The torque applied to the bar 180 and the moment arm created by the separation between the axis of the bar 180 and the line of engagement between the surfaces 182 and 188 thus results in a camming function which is transmitted through the curved engagement surface 190 between the connector bar 180 and the door 18, so that the door 18 is forced radially inward into engagement with the BOP body 20. In this embodiment, the position of the upper and lower bars 180 with respect to the BOP body 20 and the door 18 is thus as shown in FIG. 12 prior to high fluid pressure existing in the interior of the BOP body.

By over-rotating the connector bar 180 as described above, the position of the connector bar is as shown in FIG. 13 when the door is loaded, i.e., when high pressure in the interior of the BOP body 20 is present. High pressure in the interior of the BOP thus results in a slight clockwise rotation of the bar 180 from the position as shown in FIG. 12 as shown in FIG. 13, so that the planar face 184 of the bar comes into planar engagement with both the surface 186 of the lock bar 180 and the surface 188 of the BOP body 20.

By providing an elongate connector bar 180 as shown in FIGS. 12 and 13, and by over-rotating the connector bar to the initial position as shown in FIG. 12, the camming function is thus achieved to force the door 18 tighter into engagement with the BOP body 20. This over-rotation also results in the desired planar engagement of the surface 184 of the connector bar 180 with both the planar surfaces 186 and 188 of the lock bar 82 and the door 20, respectively, when the interior of the BOP is pressurized.

A camming surface may thus be provided on each connector bar for engagement with a mating camming surface provided on either the door or the BOP body. Various camming arrangements are possible. A camming surface need only be provided on either the connecting bar or on a surface of either the door or the BOP body engaged by the connector bar.

Figure 14:
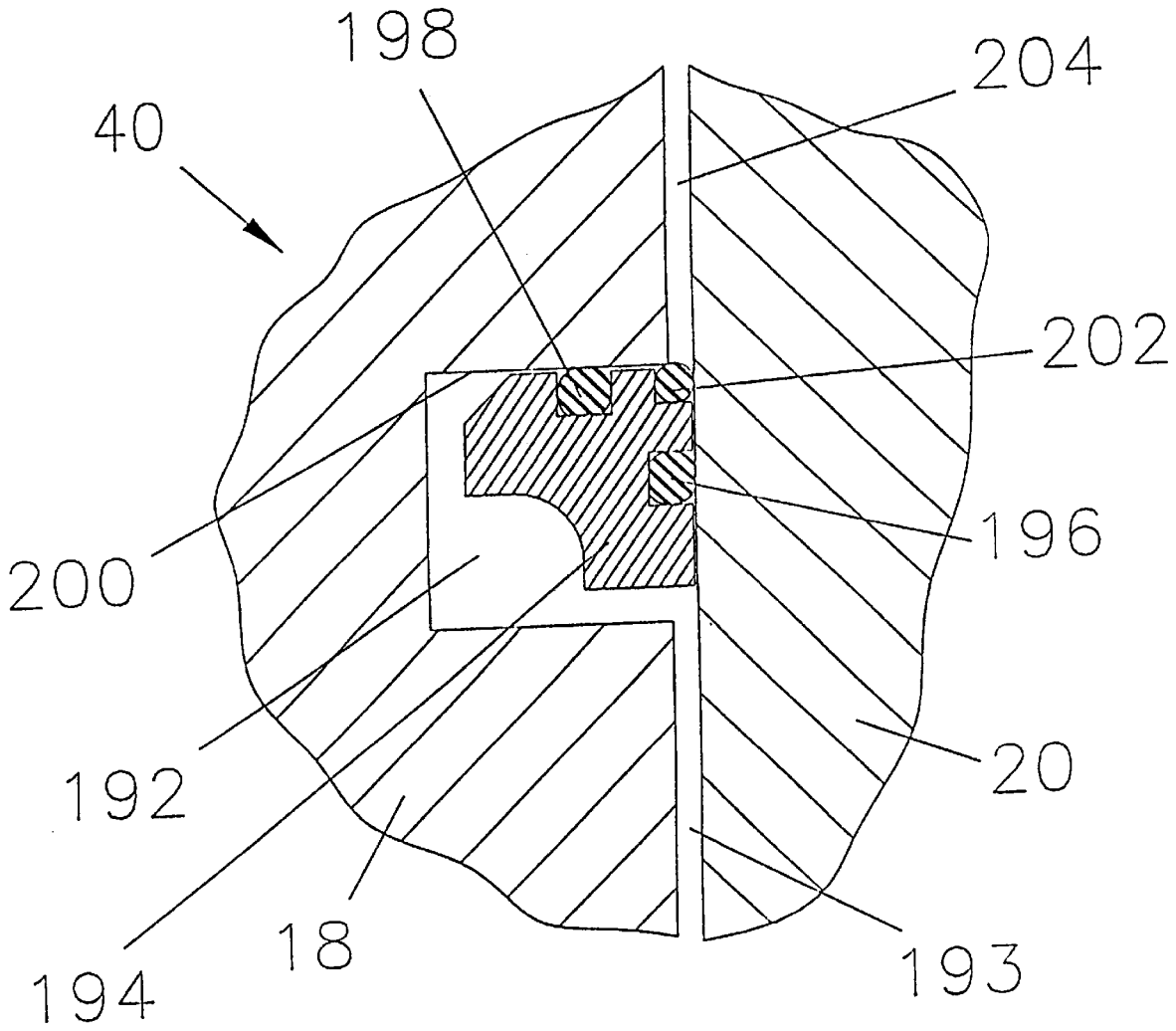
FIG. 14 is a cross-sectional view illustrating a fluid pressurized seal ring in sealing engagement with a door and the BOP body when high fluid pressure is within the body of the BOP.

FIG. 14 illustrates in cross-section the configuration of the pressure-energized seal ring 40 generally shown in FIG. 2 for sealing between the door 18 of the BOP body 20. The seal ring 40 is provided within a groove 192 formed in the door, with the groove 192 being in fluid communication with the chamber 26 in the BOP body via the unsealed passageway 193. The seal ring 40 includes a metal carrier ring 194 with a face seal 196 for sealing between the metal ring 194 and the BOP body, and a radially outward seal 198 for sealing between the metal carrier 194 and the radially outward surface 200 of the groove 192. An additional corner seal 202 may be provided as shown. Those skilled in the art will appreciate that the seal ring 40 as shown in FIG. 14 is in its pressure-energized position, and that increased fluid pressure will act upon the seal ring 40 to maintain the seal into fluid-tight engagement between the door 18 and the BOP body 20 as fluid pressure in the interior of the BOP body increases, thereby increasing the slight gap 204 between the radially inner surface of the door 18 and the mating face of the BOP body 20. Further details with respect to a suitable fluid pressure-energized seal are disclosed in U.S. Pat. No. 3,156,475, hereby incorporated by reference. A separate low pressure seal (not shown) compressed between the door and the BOP body may be used to maintain sealing engagement the door and the BOP body when low pressure exists in the interior of the BOP. The door may be considered a component of the ram assembly in some applications, since its function is to provide structural support for the ram assembly components and to reliably seal the ram assembly with the BOP body.

As noted above, the reduced axial height of the BOP body compared to prior art BOP bodies is achieved by providing an upper elongate connector bar and a lower elongate connector bar for structurally connecting the door to the BOP body. This feature may result in a BOP body with a reduced axial height, or may result in a BOP body with an axial height approximating prior art BOPs, but with the BOP of this invention including other modifications and features which otherwise could not reasonably be incorporated into the BOP without increasing the BOP axial height. An exemplary modification may be a BOP with a modified ram block which requires additional axial height. Accordingly, the door connector of the present invention allows for the incorporation of such a modified ram block without increasing the axial height of the BOP body. Other modifications and features which may be added to a BOP of the present invention without increasing the BOP body height include ram assemblies with larger diameter operators, and guiding or replacement wear features to enhance the performance of the ram blocks.

Various further modifications to the ram assemblies generally disclosed herein may be made while still utilizing the door connector concept of the present invention. For example, ram assemblies could be provided with various types of locking mechanisms to mechanically lock each ram assembly in the closed position until fluid pressure was applied to the BOP for the purpose of opening each ram assembly. Suitable ram locking mechanisms are disclosed in U.S. Pat. Nos. 5,025,708 and 5,575,452, each hereby incorporated by reference. Those skilled in the art will appreciate that other types of locking mechanisms may be used to lock BOP ram assemblies. The ram assembly may also be partially pressure balanced, as disclosed in U.S. Ser. No. 08/769,160, filed Dec. 18, 1996, now U.S. Pat. No. 5,735,502.

The method of removably securing a door to the body of a BOP will be suggested from the foregoing disclosure. Once the door is moved into position for sealing engagement with the BOP body, an upper elongate connector bar as described herein may be moved from an unlocked position to a locked position for securing the door to the BOP body. At the same time (or subsequently or prior thereto), a lower elongate connector bar as described herein may be moved from the unlocked position to the locked position. Depending on the design utilized, each connector bar may be rotated about its respective bar axis for being moved to the locked position, or each connector bar may be moved along its respective bar axis from its unlocked position to its locked position. If a locking bar is utilized, each locking bar may be moved along a locking bar axis from its release position to its locked position to prevent rotation of the respective connector bar to its unlocked position. The operation of moving the upper and lower connector bars to the locked position may produce a camming force for pressing the door toward the respective BOP body, as described herein. Each connector bar may be manually moved between the locked and the unlocked positions, or one or more powered actuators may be energized for moving the connector bars between the locked and unlocked positions.

The ram assemblies described above are suited for sealing with the oilfield tubular, and accordingly each ram block 24 as shown in FIGS. 1 and 2 includes an elastomeric seal 25 to provide reliable sealing engagement between the ram block and the oilfield tubular. The door connector concept of the present invention also has application in other types of ram assemblies, including particularly shearing ram assemblies of the type disclosed in U.S. Pat. No. 5,400,857.

The BOP may include a pair of opposing upper ram assemblies and a pair of lower ram assemblies with identical ram blocks if redundant operation is desired. Alternatively, the upper set of ram blocks may be provided for sealing about one size oilfield tubular, while the lower set of ram blocks may be actuated for sealing about a different size oilfield tubular. In yet another embodiment, the lower ram blocks may be intended for sealing about the annulus between the oilfield tubular and the BOP body, while an upper set of ram blocks are intended to shear the oilfield tubular and completely close off any fluid flow through the BOP. Each of the pair of opposing upper and lower ram assemblies may thus be separately controlled.

Various additional modifications to the BOP, the door, and the ram assemblies described herein should be apparent from the above description of the preferred embodiments. Although the invention has thus been described in detail for these embodiments, it should be understood that this explanation is for illustration, and that the invention is not limited to the described embodiments. Alternative components and operating techniques should be apparent to those skilled in the art in view of this disclosure. Modifications are thus contemplated and may be made without departing from the spirit of the invention, which is defined by the claims.

What is claimed is:

1. A blowout preventer for use in the hydrocarbon recovery operations to prevent a well blowout, comprising:

a BOP body having a central passageway therein defining the BOP central axis for receiving an oilfield tubular, the BOP body having radially opposing side faces;

first and the second radially opposing doors each for sealing engagement with a corresponding side face on the BOP body;

first and second ram assemblies each supported on a respective door for driving corresponding first and second ram blocks into engagement with the oilfield tubular;

first and second door connectors each for securing a corresponding one of the first and second doors to the BOP body, each door connector including an upper elongate connector bar having an upper bar axis generally perpendicular to the BOP central axis and securing the door to the BOP body, and a lower elongate connector bar having a lower bar axis generally perpendicular to the BOP central axis for securing the door to the BOP body, each upper and lower connector bar being movable with respect to the BOP body from a locked position for locking the door into sealing engagement with the BOP body to an unlocked position for structurally releasing the door from the BOP body, such that the door may be disengaged from the BOP body when the upper and lower connector bars are in the unlocked position for a BOP servicing operation; and at least one powered locking actuator for moving the upper connector bar and the lower connector bar between the locked position and the unlocked position.

2. The blowout preventer as defined in claim 1, wherein the upper connector bar and the lower connector bar are each rotated about its respective bar axis between the locked position and the unlocked position.

3. The blowout preventer as defined in claim 2, further comprising:

each door connector including an upper locking bar and a lower locking bar, each locking bar being movable along a respective locking bar axis from a lock position to a release position, each locking bar being positioned when in the lock position for preventing rotation of a respective connector bar, and when in the release position allowing rotation of the respective connector bar.

4. The blowout preventer as defined in claim 1, wherein each of the upper connector bar and the lower connector bar is movable along its respective bar axis from the locked position to the unlocked position.

5. The blowout preventer as defined in claim 1, wherein each of the upper connector bar and the lower connector bar includes a left-side elongate member and a right-side elongate member each independent movable with respect to the BOP body.

6. The blowout preventer as defined in claim 1, further comprising:

a camming surface on at least one of the upper elongate connector bar, the lower elongate connector bar, the BOP body, and the first and second radially opposing doors for forcing a door toward the respective side surface on the BOP body when the respective connector bar is moved from the unlocked position to the locked position.

7. The blowout preventer as defined in claim 1, further comprising:

first and second fluid pressured seals for sealing between the respective door and the BOP body when the respective door connector is in the locked position.

8. The blowout preventer as defined in claim 1, further comprising:

each of the first and second doors having the hinge pivotally mounting each door to the BOP body for pivotally supporting the door on the BOP body when the respective door connector is in the unlocked position.

9. The blowout preventer as defined in claim 1, further comprising:

a pair of rails secured to the BOP body for supporting a respective one of the first and second doors when the respective door connector is in the unlocked position.

10. A blowout preventer for use in the hydrocarbon recovery operations to prevent a well blowout, comprising:

a BOP body having a central passageway therein defining the BOP central axis for receiving an oilfield tubular, the BOP body having a side face spaced radially from the central passageway;

a door for mating engagement with the side face on the BOP body;

a ram assembly supported on the door for driving a ram block into engagement with the oilfield tubular;

a fluid pressure seal for sealing between the door and the BOP body, the fluid pressure seal being forced by fluid pressure toward sealing engagement with a planar face on one of the door and the BOP body;

a door connector for securing the door to the BOP body, the door connector including an upper elongate connector bar having an upper bar axis generally perpendicular to the BOP central axis and securing the door to the BOP body, and a lower elongate connector bar having a lower bar axis generally perpendicular to the BOP central axis for securing the door to the BOP body, each upper and lower connector bar having a door engaging surface thereon for mating engagement with a door connector engaging surface on the door, and having a BOP body engaging surface thereon for mating engagement with a body connector engaging surface on the BOP body, each upper and lower connector bar being movable with respect to the BOP body from a locked position for locking the door into sealing engagement with the BOP body to an unlocked position for structurally releasing the door from the BOP body such that the door may be disengaged from the BOP body when the upper and lower connector bars are in unlocked position for a BOP servicing operation; and a camming surface on at least one of the upper connector bar, the lower connector, the BOP body and the door for forcing the door toward the BOP body when the respective upper and lower connector bars are moved from the unlocked position to the locked position.

11. The blowout preventer as defined in claim 10, further comprising:

at least one powered locking actuator for moving the upper connector bar and the lower connector bar between the locked position and the unlocked position.

12. The blowout preventer as defined in claim 10, further comprising:

each door connector engaging surface on the door and each connector engaging surface defining a sidewall of a respective one of a generally elongate upper cavity and generally elongate lower cavity formed between the door and the BOP body when the door is in mating engagement with the BOP body.

13. A blowout preventer for use in the hydrocarbon recovery operations to prevent a well blowout, comprising:

a BOP body having a central passageway therein defining the BOP central axis for receiving an oilfield tubular, the BOP body having a side face spaced radially from the central passageway;

a door for mating engagement with the side face on the BOP body;

a ram assembly supported on the door for driving a ram block into engagement with the oilfield tubular;

a seal for sealing between the door and the BOP body; and a door connector for securing the door to the BOP body, the door connector including an upper elongate connector bar having an upper bar axis generally perpendicular to the BOP central axis and securing the door to the BOP body, and a lower elongate connector bar having a lower bar axis generally perpendicular to the BOP central axis for securing the door to the BOP body, each upper and lower connector bar being rotatable about its respective bar axis from a locked position for locking the door into sealing engagement with the BOP body to an unlocked position for structurally releasing the door from the BOP body, such that the door may be disengaged from the BOP body when the upper and lower connector bars are in the unlocked position for a BOP servicing operation.

14. The blowout preventer as defined in claim 13, further comprising:

each door connector including an upper locking bar and a lower locking bar, each locking bar being movable along a respective locking bar axis from a lock position to a release position, each locking bar being positioned when in the lock position for preventing rotation of a respective connector bar, and when in the release position allowing rotation of the respective connector bar.

15. The blowout preventer as defined in claim 13, further comprising:

at least one powered locking actuator for moving the upper connector bar and the lower connector bar between the locked position and the unlocked position.

16. The blowout preventer as defined in claim 13, further comprising:

a camming surface on each of the upper and lower connector bars for engaging the BOP body, each camming surface being spaced from the respective bar axis, such that when the connector bar is in an over-rotated position and prior to high pressure existing in the central passageway in the BOP body, the camming surface applies a force to urge the door into tighter engagement with the BOP body, a planar surface of each connector bar being in planar engagement with a mating surface on the BOP body when the connector bar rotates from the over-rotated position in response to fluid pressure in the central passageway in the BOP body.

17. A method of removably securing a door to the body of a blowout preventer for use in the hydrocarbon recovery operations to prevent a well blowout, the BOP body having a central passageway therein defining the BOP central axis for receiving an oilfield tubular and a side face spaced radially from the central passageway, a ram assembly being supported on the door for driving a ram block into engagement with the oilfield tubular, the method comprising:

rotating an upper elongate connector bar about an upper bar axis generally perpendicular to the BOP central axis from an unlocked position to a locked position for securing the door to the BOP body; and rotating a lower elongate connector bar about a lower bar axis generally perpendicular to the BOP central axis from an unlocked position to a locked position for securing the door to the BOP body, such that the door may be disengaged from the BOP body when the upper and lower connector bars are in the unlocked position for a BOP servicing operation.

18. The method as defined in claim 17, further comprising:

moving an upper locking bar and a lower locking bar each along a respective locking bar axis from a lock position to a release position, each locking bar being positioned when in the lock position for preventing rotation of a respective connector bar, and when in the release position allowing rotation of the respective connector bar.

19. The method as defined in claim 17, further comprising:

providing a camming surface on at least one of the upper elongate connector bar, the lower elongate connector bar, the BOP body, and the door; and moving the upper and the lower connector bar to the locked position produces a camming force for forcing the door toward the BOP body.

20. The method as defined in claim 17, further comprising:

powering a locking actuator for moving the upper connector bar and the lower connector bar to the locked position.

21. A method of removably securing a door to the body of a blowout preventer for use in the hydrocarbon recovery operations to prevent a well blowout, the BOP body having a central passageway therein defining the BOP central axis for receiving an oilfield tubular and a side face spaced radially from the central passageway, a ram assembly being supported on the door for driving a ram block into engagement with the oilfield tubular, the method comprising:

providing an upper elongate connector bar movable with respect to the BOP body from an unlocked position to a locked position for securing the door to the BOP body;

providing a lower elongate connector bar movable with respect to the BOP body from an unlocked position to a locked position for securing the door to the BOP body; and powering a locking actuator for moving both the upper connector bar and the lower connector bar from the unlocked position to the locked position for securing the door to the BOP body, such that the door may be disengaged from the BOP body when the upper and lower connector bars are in the unlocked position for a BOP servicing operation.

22. The method as defined in claim 21, further comprising:

providing a camming surface on at least one of the upper elongate connector bar, the lower elongate connector bar, the BOP body, and the door; and moving the upper and the lower connector bar to the locked position produces a camming force for forcing the door toward the BOP body.

23. A blowout preventer for use in the hydrocarbon recovery operations to prevent a well blowout, comprising:

a BOP body having a central passageway therein defining the BOP central axis for receiving an oilfield tubular, the BOP body having radially opposing side faces;

first and the second radially opposing doors each for sealing engagement with a corresponding side face on the BOP body;

first and second ram assemblies each supported on a respective door for driving corresponding first and second ram blocks into engagement with the oilfield tubular;

first and second door connectors each for securing a corresponding one of the first and second doors to the BOP body, each door connector including an upper elongate connector bar having an upper bar axis generally perpendicular to the BOP central axis and securing the door to the BOP body, and a lower elongate connector bar having a lower bar axis generally perpendicular to the BOP central axis for securing the door to the BOP body, each upper and lower connector bar being movable with respect to the BOP body from a locked position for locking the door into sealing engagement with the BOP body to an unlocked position for structurally releasing the door from the BOP body, such that the door may be disengaged from the BOP body when the upper and lower connector bars are in the unlocked position for a BOP servicing operation;

first and second fluid pressured seals for sealing between a door sealing face of a respective door and a body sealing face of the BOP body when the respective door connector is in the locked position, each fluid pressurized seal being forced by fluid pressure toward sealing engagement with a planar sealing face on one of the BOP body and a respective door; and a camming surface on at least one of the upper elongate connector bar, the lower elongate connector bar, the BOP body, and the first and second radially opposing doors for forcing a respective door toward the respective side surface on the BOP body when the respective connector bar is moved from the unlocked position to the locked position.

24. The blowout preventer as defined in claim 23, wherein the upper connector bar and the lower connector bar are each rotated about its respective bar axis between the locked position and the unlocked position.

25. The blowout preventer as defined in claim 24, further comprising:

each door connector including an upper locking bar and a lower locking bar, each locking bar being movable along a respective locking bar axis from a lock position to a release position, each locking bar being positioned when in the lock position for preventing rotation of a respective connector bar, and when in the release position allowing rotation of the respective connector bar.

26. The blowout preventer as defined in claim 23, wherein each of the upper connector bar and the lower connector bar is movable along its respective bar axis from the locked position to the unlocked position.

27. The blowout preventer as defined in claim 23, further comprising:

a pair of rails secured to the BOP body for supporting a respective one of the first and second doors when the respective door connector is in the unlocked position.

28. A blowout preventer for use in the hydrocarbon recovery operations to prevent a well blowout, comprising:

a BOP body having a central passageway therein defining the BOP central axis for receiving an oilfield tubular, the BOP body having a side face spaced radially from the central passageway;

a door for mating engagement with the side face on the BOP body;

a hinge for pivotally mounting the door to the BOP body and supporting the door on the BOP body when the door is in the unlocked position for a BOP servicing operation;

a ram assembly supported on the door for driving a ram block into engagement with the oilfield tubular;

a fluid pressure seal for sealing between the door and the BOP body, the fluid pressure seal being forced by fluid pressure toward sealing engagement with a planar face on one of the door and the BOP body; and a door connector for securing the door to the BOP body, the door connector including an upper elongate connector bar having an upper bar axis generally perpendicular to the BOP central axis and securing the door to the BOP body, and a lower elongate connector bar having a lower bar axis generally perpendicular to the BOP central axis for securing the door to the BOP body, each upper and lower connector bar having a door engaging surface thereon for mating engagement with a door connector engaging surface on the door, and having a BOP body engaging surface thereon for mating engagement with a body connector engaging surface on the BOP body, each upper and lower connector bar being movable with respect to the BOP body from a locked position for locking the door into sealing engagement with the BOP body to an unlocked position for structurally releasing the door from the BOP body, such that the door may be disengaged from the BOP body when the upper and lower connector bars are in the unlocked position for a BOP servicing operation.

29. The blowout preventer as defined in claim 28, wherein the upper connector bar and the lower connector bar are each rotated about its respective bar axis between the locked position and the unlocked position.

30. The blowout preventer as defined in claim 29, further comprising:

the door connector including an upper locking bar and a lower locking bar, each locking bar being movable along a respective locking bar axis from a lock position to a release position, each locking bar being positioned when in the lock position for preventing rotation of a respective connector bar, and when in the release position allowing rotation of the respective connector bar.

31. The blowout preventer as defined in claim 28, wherein each of the upper connector bar and the lower connector bar is movable along its respective bar axis from the locked position to the unlocked position.

32. The blowout preventer as defined in claim 28, further comprising:

a camming surface on at least one of the upper connector bar, the lower connector bar, the BOP body and the door for forcing the door toward the BOP body when the respective upper and lower connector bars are moved from the unlocked position to the locked position.

* * * * *